US006679174B1

(12) United States Patent
Mulinix

(10) Patent No.: US 6,679,174 B1
(45) Date of Patent: Jan. 20, 2004

(54) FLARE IGNITER WITH A SLURRY GROOVE

(75) Inventor: David J. Mulinix, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/263,281

(22) Filed: Sep. 26, 2002

(51) Int. Cl.[7] ..... F42C 15/20; F42C 15/34
(52) U.S. Cl. ..... 102/259; 102/222; 102/254
(58) Field of Search ..... 102/259, 222, 102/254, 336, 335, 470, 202

(56) References Cited

U.S. PATENT DOCUMENTS

| | | | | |
|---|---|---|---|---|
| 3,392,672 | A | | 7/1968 | Noles |
| 3,423,931 | A | | 1/1969 | Schwarz |
| 3,529,418 | A | | 9/1970 | Puckett |
| 4,029,014 | A | | 6/1977 | Cunningham |
| 4,406,227 | A | | 9/1983 | Beeker et al. |
| 4,573,411 | A | | 3/1986 | Liebhardt et al. |
| 4,599,945 | A | | 7/1986 | Groustra et al. |
| 4,683,823 | A | | 8/1987 | Dinger et al. |
| H453 | H | | 4/1988 | Schmidlin |
| 4,881,464 | A | | 11/1989 | Sayles |
| 5,033,383 | A | | 7/1991 | Edminster |
| 5,063,847 | A | | 11/1991 | Halssig et al. |
| 5,561,259 | A | * | 10/1996 | Herbage et al. ..... 102/334 |
| H1603 | H | | 11/1996 | Deckard et al. |
| 5,635,666 | A | | 6/1997 | Bannasch et al. |
| 5,801,321 | A | | 9/1998 | LaGrange et al. |
| 6,170,399 | B1 | | 1/2001 | Nielson et al. |

* cited by examiner

*Primary Examiner*—Michael J. Carone
*Assistant Examiner*—Aileen B. Felton
(74) *Attorney, Agent, or Firm*—Mark O. Glut

(57) ABSTRACT

An igniter for a flare that includes a housing and a slider assembly. The housing includes an ignition device portion and a slurry groove portion. The ignition device portion has an ignition device portal for holding an ignition device, while the slurry groove portion has a groove for ignition slurry. The slider assembly is disposed within the housing, the slider assembly has an armed position and a safe position, the armed position not covering the ignition device portal allowing the ignition device disposed within the ignition device portals to ignite the ignition slurry, which ignites the flare, the safe position covering the ignition device portal and preventing ignition of the flare.

15 Claims, 3 Drawing Sheets

FLARE IGNITER WITH A SLURRY GROOVE

STATEMENT OF GOVERNMENT INTEREST

The invention described herein may be manufactured and used by or for the Government of the United States of America for governmental purposes without payment of any royalties thereon or therefor.

BACKGROUND

The present invention relates to an igniter for a flare. More specifically, but without limitation, the present invention relates to an aerial flare igniter with a slurry groove.

Aerial flares are used for a variety of applications, including, but not limited to, illumination, signaling, marking, decoys, military countermeasures, and the like. A flare is typically defined, but without limitations, as a pyrotechnic device designed to produce a luminous signal or illumination. Due to the important nature of their uses, aerial flares require a high degree of reliability in their ignition systems. The flare must not prematurely ignite, which can cause damage to the platform from which the flare is being released. (A platform can be, for instance, but without limitation, a stand, an aircraft, a ship, a submarine, or a land vehicle.)

Typically military flares, especially U.S. Navy flares, utilize an end groove, which is machined directly into the cross sectional area of the flare grain (the illuminant, or the pyrotechnic material of the flare.) This groove is usually machined on the aft (rear) end of a flare, specifically the bottom portion of the aft end of the flare grain. In a typical U.S. Navy flare, the bottom portion of the aft end of the flare grain is in communication with the flare igniter. Ignition slurry is added to this groove. Ignition slurry can be defined, but without limitation, as a suspension of pyrotechnic material that aids in the ignition of the flare grain. Ignition slurry improves ignition performance of a flare and typically improves ignition reliability.

The United States Navy had in the past exclusively used cylindrical flares, but is now utilizing more rectangular shaped flares, as well as other shaped flares. The machining process of the groove directly on the flare grain is easy to perform on a cylindrical flare because a circular groove is needed. A circular groove can be easily machined with a lathe or a drilling type fixture set up with a cutting tool. On a rectangular shaped flare or other shaped flare, machining a groove on the flare grain end is costly and difficult. Such a groove would likely require a CNC mill.

Furthermore, this process requires additional handling of the grain as well as well as increased safety risk due to the fact ignition slurry is directly on the grain or pyrotechnic material. There have been numerous injuries and several deaths during the course of manufacture of such a flare. Because of this risk and danger most manufacturers do not manufacture this type of flare, which causes supply problems for the U.S. Navy.

In addition, there is a great deal of waste of flare grain, as it is machined away from the main body of the flare. These shavings also create environmental concerns as these shavings must be burned to ensure proper disposal. The burning of the flare grain shavings cause additional pollution as well as another safety risk, and the need for appropriate flare grain shavings burning grounds.

For the foregoing reasons, there is a need for a flare igniter with a slurry groove.

SUMMARY

The instant invention is directed to a flare igniter with a slurry groove that satisfies the needs enumerated above and below.

The present invention is directed to a flare igniter with a housing and a slider assembly. The housing includes an ignition device portion and a slurry groove portion. The ignition device portion has an ignition device portal for holding an ignition device, while the slurry groove portion has a groove for ignition slurry. The slider assembly is disposed within the housing, the slider assembly has an armed position and a safe position. In the armed position the ignition device portal is not covered, allowing the ignition device disposed within the ignition device portal to ignite the ignition slurry, which ignites the flare, the safe position covering the ignition device portal and preventing ignition of the flare.

It is an object of the invention to provide a flare igniter with a slurry groove that prevents and minimizes premature ignition of a flare, and has high degree of reliability in its ignition.

It is an object of the invention to provide a flare igniter with a slurry groove that substantially assures that flare grains are completely exited from their outer case before ignition.

It is an object of the invention to provide a flare igniter with a slurry groove that can easily be utilized on cylindrically shaped flares, rectangularly shaped flares, or any other shaped flares.

It is an object of the invention to provide a flare igniter with a slurry groove that increases safety and reduces cost of manufacture.

It is an object of the invention to provide a flare igniter with a slurry groove that minimizes handling of the flare grain.

It is an object of the invention to provide a flare igniter with a slurry groove that minimizes ignition slurry being in direct contact with the flare grain.

DRAWINGS

These and other features, aspects and advantages of the present invention will become better understood with reference to the following description and appended claims, and accompanying drawings wherein:

DESCRIPTION

Figure 1:
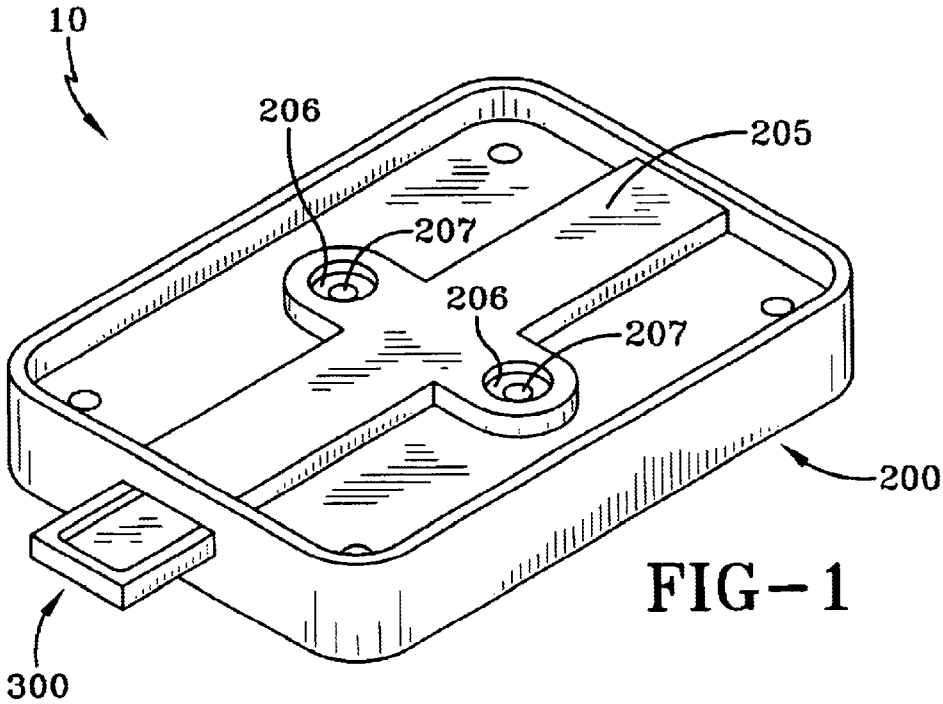
FIG. 1 is a bottom view of one of the embodiments of the igniter with a slurry groove.
Figure 2:
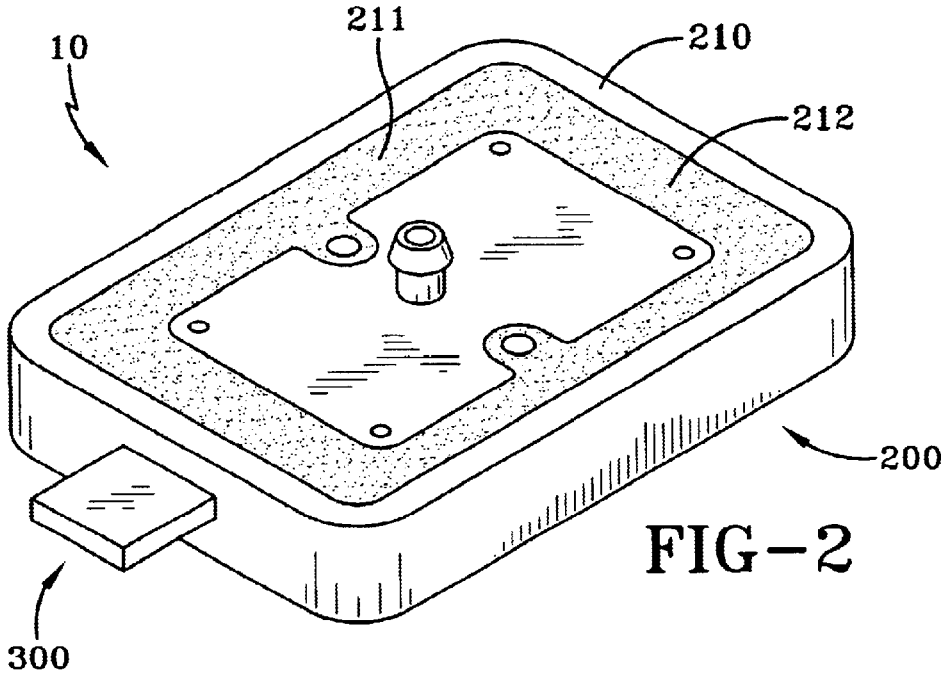
FIG. 2 is a top view of one of the embodiments of the igniter with a slurry groove.
Figure 3:
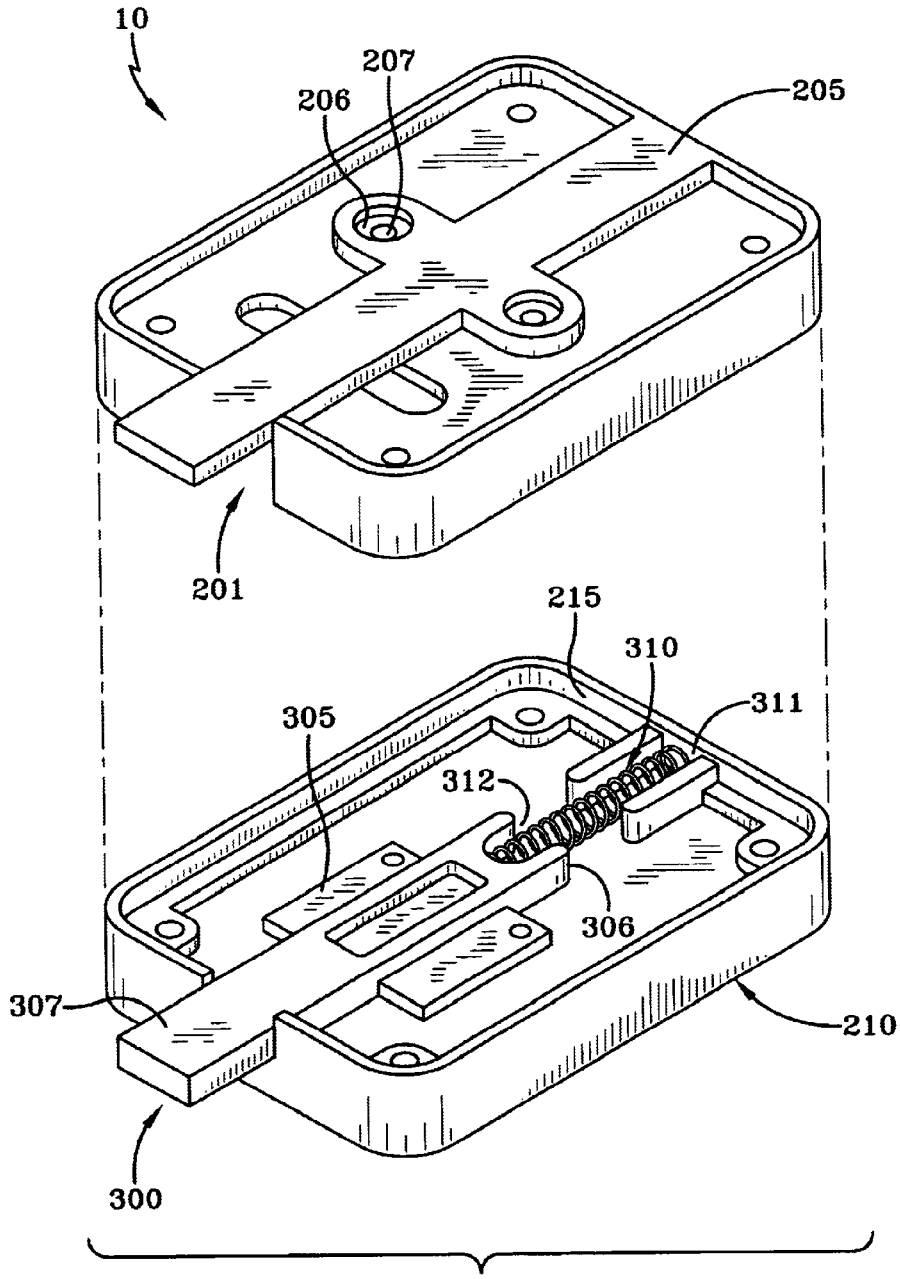
FIG. 3 is an partially exploded bottom view of one of the embodiments of the igniter with a slurry groove.

The preferred embodiments of the present invention are illustrated by way of example below and in FIGS. 1, 2, 3, and 4. As seen in FIGS. 1–4, the flare igniter with a slurry groove 10 includes a housing 200 and a slider assembly 300. As seen in FIG. 3, the housing 200 has an ignition device portion 205 and a slurry groove portion 210. The slurry groove portion 210 may be superposed on the ignition device portion 205. As seen in FIG. 3, the ignition device portion 205 may be engaged with and within the slurry groove portion 210. As seen in FIGS. 1–4, the housing 200 may be substantially rectangular and may have rounded edges. Typically the housing 200 shape corresponds to the shape of the flare cross section, which may be any type of shape.

Figure 4:
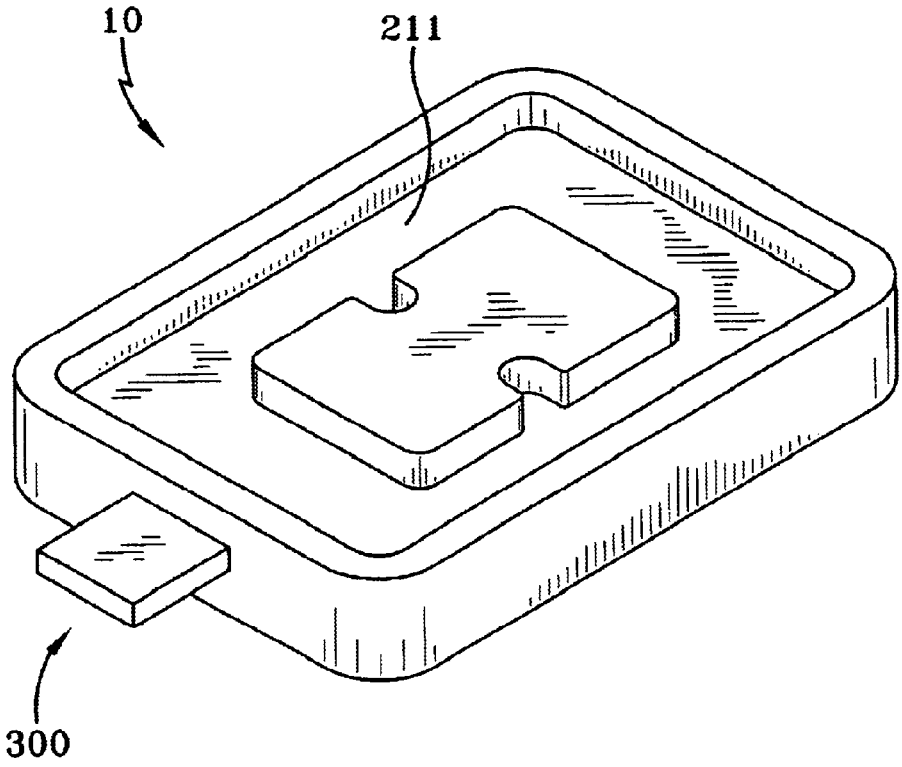
FIG. 4 is a top view of one of the embodiments of the igniter with a slurry groove without any slurry disposed within the groove.

The ignition device portion 205 may include an ignition device portal 206. The ignition device portal 206 may be, but without limitation, an entrance, an aperture, a cavity, a chamber, a passage, an embrasure, a groove, a filister, a foramen, a notch, a gain, a rabbet, a sulcus, a furrow, a cup, a holder, and the like, that can accept or hold an ignition device. The ignition device may be, but without limitation, an ignition pellet 207 or any type of device that can ignite a flare. As seen in FIGS. 1 and 3, the preferred embodiment includes two ignition device portals 206, each containing an ignition device or ignition pellet 207. The slurry groove portion 210 may include a groove 211 for ignition slurry 212. A groove 211 is typically defined as a long narrow cut or indentation in a surface. The groove 211 may be, but without limitation, an entrance, a cavity, a chamber, a passage, an embrasure, a filister, a foramen, a notch, a gain, a rabbet, a sulcus, a furrow, a channel, a track, and the like, that can hold and accept ignition slurry 212. As seen in FIGS. 2 and 4 the groove 211 may follow along the edge of slurry groove portion 210. In an assembled flare, the slurry groove portion 210 is in physical contact with the flare grain of the flare such that the ignition slurry 212 when ignited could ignite the flare grain.

The ignition slurry 212 typically has the same composition as flare grain and the ignition device. In the preferred embodiment, the ignition slurry 212 is made from a mixture of a fuel, an oxidizer, and a binder. The preferred fuel is magnesium powder. The preferred oxidizer is Polytetrafluoroethylene (Teflon powder). The preferred binder is fluoroelastomer, which can be found under the brand names of Viton® (manufactured by Dupont) or Fluorel® (manufactured by 3M). To mix the ignition slurry 212, the binder, which is typically a rubbery substance that is in sheet form, is cut into small chunks and placed in a container with a solvent; the preferred solvent is acetone. The solvent dissolves the binder; and the oxidizer and fuel are combined with the binder/solvent to produce a homogenous mix.

After preparation, the ignition slurry 212 is applied to the groove 211 in liquid form. It is viscous and is applied with a small brush or dispensed in bead form from a squeeze bottle or air powered dispenser. After ignition slurry 212 application, the ignition slurry 212 and the igniter 10 or the slurry groove portion 210 is placed in a vented oven to evaporate the solvent or acetone. The dried ignition slurry 212, unlike extruded or pressed flare grain, is porous and lights very easily and burns extremely rapidly.

The slider assembly 300 may include a slider 305 and a compression spring 310. However, the slider assembly 300 may be any type of slider or slider system that is an arm-safe type system. As seen in FIG. 3, the slider assembly may be disposed within the slurry groove portion 210. The slider assembly 300 can have an "armed" position and a "safe" position, whereby the armed position uncovers the ignition device portal 206, and the safe position covers the ignition device portal 206. In the armed position the ignition device disposed within the ignition device portals 206 communicate conflagrantly, pyrotechnically, or chemically with the ignition slurry 212 and may ignite the ignition slurry 212, which in turn ignites the grains or pyrotechnic material of the flare. In the safe position the ignition device cannot conflagrantly, pyrotechnically, or chemically communicate with the ignition slurry 212, and cannot ignite the ignition slurry 212.

The slider 305 may have a slider first end 306 and a slider second end 307. The slider first end 306 may communicate with a compression spring 310. The housing 200 (on both the ignition portal portion 205 and slurry groove portion 210) may have a slider aperture 201 that allows passage of the slider second end 307. The slider second end 307 may pass through the slider aperture 201 and press against the inside of the flare case. A flare case typically holds the flare grain or pyrotechnic material.

The compression spring 310 may include a spring first end 311 and a spring second end 312. The spring first end 311 may press against the inner wall of the housing 200, specifically the slurry groove portion inner wall 215, while the spring second end 312 may be attached to the slider first end 306. When the igniter is in the safe position, the slider second end 307 presses against the inside of the flare case positioning the slider 305 so it covers the ignition device portal 206 and the ignition device cannot conflagrantly, pyrotechnically or chemically communicate with the ignition slurry 212.

During flare function, an impulse cartridge ejects the igniter/grain assembly from the case. Hot gases from the impulse cartridge ignite the ignition pellets 207 disposed within the ignition device portals 206. When the igniter/grain assembly clears the case, the slider assembly 300 is powered under force of the compression spring 310 to uncover the ignition device portal 206. This is the armed position. Flame from the burning ignition pellets 207 goes through the ignition portals 206 and ignites the ignition slurry 212 in the slurry groove 211. The burning ignition slurry 212 drives hot gases through longitudinal slots in the flare grain and the flare grain ignites.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. An igniter for a flare, comprising:

(a) a housing, the housing comprising an ignition device portion and a slurry groove portion, the ignition device portion comprising an ignition device portal for holding an ignition device, the slurry groove portion comprising a groove for ignition slurry; and (b) a slider assembly, the slider assembly disposed within the housing, the slider assembly having an armed position and a safe position, the armed position not covering the ignition device portal allowing the ignition device disposed within the ignition device portals to ignite the ignition slurry, which ignites the flare, the safe position covering the ignition device portal and preventing ignition of the ignition slurry and the flare.

2. The igniter for a flare of claim 1, wherein the slider assembly comprises of a slider and a spring, the spring attached to the slider, in the safe position the slider covering the ignition device portal and preventing ignition of the flare.

3. The igniter for a flare of claim 2, wherein the slider includes a slider first end and a slider second end, the slider first end is attached to the spring, the housing having a slider aperture that allows passage of the slider second end.

4. The igniter for a flare of claim 3, wherein the flare includes a flare case, the flare case includes an inner wall, in the safe position the slider second end presses against the inner wall, tensions the spring and covering the ignition portal device.

5. The igniter for a flare of claim 4, wherein the flare further includes flare grain with longitudinal slots.

6. The igniter for a flare of claim 5, wherein the spring is a compression spring.

7. The igniter for a flare of claim 6, wherein the flare further comprises ignition slurry, the ignition slurry disposed within the groove for ignition slurry.

8. An igniter for a flare, comprising:

(a) a housing, the housing comprising an ignition device portion and a slurry groove portion, the ignition device portion comprising an ignition device portal for holding an ignition device, the slurry groove portion comprising a groove for ignition slurry, the housing further having a slider aperture;

(b) a slider assembly, the slider assembly disposed within the housing, the slider assembly having an armed position and a safe position, the slider assembly comprising of a slider and a compression spring, the compression spring attached to the slider, in the safe position the slider covering the ignition device portal and preventing ignition of the flare, in the armed position the slider not covering the ignition device portal, the slider including a slider first end and a slider second end, the slider first end is attached to the spring, the housing further comprising a slider aperture, the slider aperture allowing passage of the slider second end, the flare case includes an inner wall, in the safe position the slider second end passes through the slider aperture and presses against the inner wall, tensions the spring and covering the ignition portal device; and (c) ignition slurry disposed within the groove for ignition slurry.

9. The igniter for a flare of claim 8, wherein the ignition slurry is a mixture of a fuel, an oxidizer and a binder.

10. The igniter for a flare of claim 9, wherein the ignition slurry is made utilizing the method of:

(a) mixing the binder with a solvent;

(b) dissolving the binder in the solvent; and (c) adding the fuel and oxidizer to the solvent binder mixture.

11. The igniter for a flare of claim 10, wherein the solvent is acetone.

12. The igniter for a flare of claim 11, wherein the ignition slurry is placed in the groove for ignition slurry, and then the solvent is evaporated from the ignition slurry.

13. The igniter for a flare of claim 9, wherein the fuel is magnesium powder.

14. The igniter for a flare of claim 13, wherein the oxidizer is Polytetrafluoroethylene.

15. The igniter for a flare of claim 14, wherein the binder is a fluoroelastomer.

* * * * *